US009831587B2

(12) United States Patent
Cormier et al.

(10) Patent No.: US 9,831,587 B2
(45) **Date of Patent: *Nov. 28, 2017**

(54) ELECTRICAL TERMINAL FOR A FEMALE CONNECTOR

(71) Applicant: Delphi International Operations Luxembourg, S.A.R.L., Bascharage (LU)

(72) Inventors: Francois Cormier, Dammarie sur Loing (FR); Sylvain Bossuyt, Boutigny Prouais (FR); Patrice Cappe, Faverolles (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 15/413,953

(22) Filed: Jan. 24, 2017

(65) Prior Publication Data

US 2017/0141502 A1 May 18, 2017

Related U.S. Application Data

(63) Continuation-in-part of application No. 15/295,202, filed on Oct. 17, 2016.

(30) Foreign Application Priority Data

Oct. 27, 2015 (EP) ..... 15191746

(51) Int. Cl.

| | |
|---|---|
| ***H01R 3/00*** | (2006.01) |
| ***H01R 13/187*** | (2006.01) |
| ***H01R 13/11*** | (2006.01) |

(52) U.S. Cl.
CPC ..... *H01R 13/187* (2013.01); *H01R 13/11* (2013.01); *H01R 13/113* (2013.01)

(58) Field of Classification Search
CPC ..... H01R 13/11; H01R 13/187
(Continued)

(56) References Cited

U.S. PATENT DOCUMENTS 8,858,274 B2 * 10/2014 Jakoplic ..... H01R 13/11 439/843
9,099,796 B2 * 8/2015 Myer ..... H01R 13/113
(Continued)

FOREIGN PATENT DOCUMENTS

| | | |
|---|---|---|
| WO | 2008120048 A1 | 10/2008 |
| WO | 2010015894 A1 | 2/2010 |
| WO | 2014127818 A1 | 8/2014 |

*Primary Examiner* — Abdullah Riyami
*Assistant Examiner* — Nader Alhawamdeh
(74) *Attorney, Agent, or Firm* — Robert J. Myers

(57) ABSTRACT

The present invention relates to an electrical terminal for a female connector. The terminal includes a contact blade having a first sheet plane. The contact blade is configured to contact an electrical pin with a contact force when the terminal is mated with the electrical and a separate support blade having a second sheet plane. The support blade engages with a corresponding contact blade to increase the contact force. The first and second sheet planes are orientated substantially perpendicular to each other. The support blade includes an engaging portion configured to engage the corresponding contact blade transversely in a middle of the corresponding contact blade.

19 Claims, 3 Drawing Sheets

(58) Field of Classification Search
USPC ..... 439/889
See application file for complete search history.

(56) References Cited

U.S. PATENT DOCUMENTS

| | | | | |
|---|---|---|---|---|
| 9,118,131 | B2 * | 8/2015 | Jakoplic | H01R 13/17 |
| 2002/0076999 | A1 * | 6/2002 | Chen | H01R 13/187 439/851 |
| 2003/0049976 | A1 * | 3/2003 | Kato | H01R 13/187 439/856 |
| 2005/0085139 | A1 * | 4/2005 | Copper | H01R 13/057 439/852 |
| 2013/0244510 | A1 * | 9/2013 | Jakoplic | H01R 13/11 439/877 |
| 2013/0273790 | A1 * | 10/2013 | Jakoplic | H01R 13/17 439/891 |
| 2014/0357138 | A1 * | 12/2014 | Nakamura | H01R 13/113 439/884 |
| 2015/0017844 | A1 | 1/2015 | Nakagishi | |
| 2015/0087192 | A1 * | 3/2015 | Tanigawa | H01R 13/187 439/852 |
| 2015/0099408 | A1 * | 4/2015 | Myer | H01R 13/113 439/884 |
| 2016/0254633 | A1 * | 9/2016 | Miyakawa | H01R 43/16 |
| 2017/0047677 | A1 * | 2/2017 | Bhagyanathan | H01R 13/113 |

* cited by examiner

3

ELECTRICAL TERMINAL FOR A FEMALE CONNECTOR

CROSS-REFERENCE TO RELATED APPLICATION

This application is a continuation-in-part application and claims benefit under 35 U.S.C. §120 of U.S. patent application Ser. No. 15/295,202, filed Oct. 17, 2016, which claimed benefit under 35 U.S.C. §119(a) of Patent Application No. 15191746.5 filed in the European Patent Office on Oct. 27, 2015, the entire disclosure of each of which are hereby incorporated by reference.

TECHNICAL FIELD OF THE INVENTION

The invention relates to an electrical terminal for a female connector, preferably having small dimensions and a method to manufacture the same.

BACKGROUND OF THE INVENTION

There is a trend in the art to provide electrical connectors having smaller dimensions, for e.g. providing multiple connectors in a restricted building space. However, with the electrical connectors becoming smaller and smaller, the electrically conductive inlays of those electrical connectors, i.e. the male pins and/or the female terminals, have to become smaller as well.

Wherein male pins can be manufactured with smaller dimensions (i.e. smaller cross section) very easily, it is more challenging to provide female electrical terminals having smaller dimensions. The difficulties arise, since for providing smaller terminals typically thinner metal sheets have to be used. However, providing terminals being manufactured from thinner metal sheets, results in reduced wall thicknesses of the terminal and thus to reduced contact forces that can be achieved between the male pin and the female terminal.

This is because contact forces of a terminal are typically generated by contact blades that are formed from a sheet of metal in which the contact blades are integrally formed with the terminal. Thus, the contact force that can be applied by a contact blade of a terminal on a pin is strongly dependent on the material used, i.e. the sheet material, and the sheet thickness. Consequently, with merely providing smaller terminals, the contact force applied on the male pin will become smaller. However, the smaller terminals have to fulfill the same contact force requirements, i.e. they have to apply the same contact forces on the male pin, as terminals that are manufactured from conventional thick sheet materials.

Particularly, high contact forces are required, to provide a secure electrical contact between the male pin and the female terminal even under rough environmental conditions, such as vibrations, shock and/or the like.

In the art, terminals are known that are provided with two contact blades being arranged in a stack, to provide increased contact forces between the terminal and a pin that can be mated with the terminal. Thus, both contact blades have to be lifted when the pin is mated with the terminal, thereby increasing the contact force. However, in these terminals, the contact force is directly dependent on the material thickness used. Thus, the required contact force limits the minimal sheet thickness so that terminals being provided with stacked contact blades cannot be provided at very small dimensions.

Further, contact blades are known having an L-shaped cross section. These contact blades achieve higher contact forces, since the moment of inertia of the cross section of the contact blade is increased, compared to conventional contact blades, having a substantially rectangular cross section.

An example for an L-shaped contact blade 10 is shown, in FIGS. 1A and 1B. When a pin 50 is inserted into the terminal 1, the contact blade 10 will be lifted, while rotating along its longitudinal axis. The longitudinal rotation leads to a decrease in contact area and is therefore disadvantageous. Further, due to the L-shaped cross section, the contact blade has larger dimensions, compared to conventional rectangular contact blades. Therefore, parts of the L-shaped contact blade are typically arranged to protrude out of the terminal body of the terminal. Thus, the terminal body is open to the environment and prone to contamination, with e.g. dust, oil, moisture and/or the like. Therefore, the contact condition between the pin and the terminal, i.e. the contact blade, can be negatively influenced. Further, with the contact blade protruding out of the terminal body, a potential risk arises, that the contact blade is unintentionally lifted off the contact pin during use, since the protruding parts might engage with other parts of the surrounding.

FIG. 1A shows an electrical terminal 1 in a cut view, without an electrical pin being inserted. The electrical terminal 1 includes a contact body portion 30 and an L-shaped contact blade 10. The L-shaped contact blade 10 has a contact portion 12 and a spring portion 14. FIG. 1B shows the electrical terminal 1 in a cut view in which an electrical pin 50 is inserted. As can be seen, upon inserting the electrical pin 50 into the electrical terminal 1, the contact blade 10 is twisted around its longitudinal axis, so that only a small area of the contact portion 12 remains in contact with the electrical pin 50. Thus, the electrical conductivity between the electrical pin and the contact blade is decreased. Further, the L-shaped blade is not formed symmetrical, so that it typically protrudes with the spring portion 14 out of the body of the terminal. Thus, there is a certain risk of an unintentional lifting off the contact blade 10, so that the electrical contact between the contact portion 12 and an electrical pin 50 is opened.

Therefore, there is a need in the art to provide female terminals that can be provided with small dimension, and that are configured to provide high contact. Further, the contact blade of a terminal should be protected from the environment.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

An electrical terminal for a female connector, is presented herein. The terminal includes at least one contact blade having a first sheet plane. The contact blade is configured to contact an electrical pin with a contact force when the terminal is mated with the electrical pin; and at least one separate support blade having a second sheet plane. The support blade engages with a corresponding contact blade to increase the contact force, and wherein the first and second sheet planes are orientated substantially perpendicular to each other.

Female connectors are typically used for transmitting power and/or signals in electrical devices and/or systems. Therefore, female connectors are for example mounted on a printed circuit board and/or conductively connected to a power or signal wire, and/or the like. Further, female connectors can be provided within a housing of a device, or can be equipped with a discrete housing. To provide good contact properties, female connectors are typically provided with an electrical terminal, having at least one contact blade.

The contact blade and/or the support blade may be manufactured from a metal sheet, having a sheet thickness. The sheet plane is the main plane of a metal sheet of the contact blade, respectively the support blade, i.e. the sheet plane stands perpendicularly to the sheet thickness.

The electrical terminal may be equipped with one, two, or three contact blades. Each contact blade has a corresponding support blade. The contact blades may be arranged equidistant to each other. The contact blades are arranged to contact an electrical pin with a certain contact force when the terminal is mated with the electrical pin. This contact force is increased by the support blade(s) that engages with the corresponding contact blade. Since the first sheet plane of the contact blade and the second sheet plane of the support blade are oriented substantially perpendicular to each other, the contact force that can be applied is dependent on the geometrical shape of the support blade. The geometrical shape of the support blade can be any suitable form and can be adjusted by known shaping techniques, such as machining, cutting, embossing, stamping, or the like.

For example, is the contact blade, oriented to contact the electrical pin with its main face, i.e. a main face of the metal sheet, the contact force that can be applied solely by the contact blade (i.e. without the support blade) would be limited by the sheet thickness of the contact blade. Since the second sheet plane of the support blade is oriented perpendicular to the first sheet plane of the contact blade, the contact force that can be applied, is not limited by the sheet thickness, but by the geometrical shape of the support blade. Further, since the support blade engages with the contact blade, when the terminal is mated with the electrical pin, the achievable (overall) contact force is dependent on the geometrical shape of the support blade.

Further, the support blade may be designed to provide a desired contact force and still further the support blade may be designed to reduce occurring strain due to contact force in order to increase the lifespan of the terminal. Thus, electrical terminals can be provided that can apply a high contact force on an electrical pin when the pin is mated with the electrical terminal. The contact force is not dependent on the sheet thickness used. Further, thin metal sheets can be used to apply high contact forces so that very small terminals can be manufactured.

The terminal may include a terminal body having at least two side walls. The contact blade is centered between the two side walls. If the contact blade is centered within the terminal body, the contact blade will be lifted without being twisted around its longitudinal axis when the terminal is mated with an electrical pin. Therefore, a large contact surface between the pin and the contact blade can be maintained when mating the terminal with an electrical pin. Thus, good electrical conductivity can be achieved and contact losses can be reduced.

The contact blade may include a contact portion being configured to contact an electrical pin when the terminal is mated with the electrical pin and a spring portion. The spring portion is arranged between the contact portion and the terminal body.

The contact portion may be designed to provide good electrical contact condition between the terminal and an electrical pin. Therefore, the contact portion may be formed as a convex shape providing a defined contact area and/or provide a defined contact line with the contact pin. If the contact pin has a round cross section, the contact area between the pin and the contact portion of the contact blade is a contact point.

The spring portion that is arranged between the contact portion and the terminal body allows the contact blade to be bent resiliently. Thus, multiple mating actions can be performed without damaging the terminal. Further, the initial contact force being applied solely by the contact blade is dependent on the length of the spring portion. Thus, the initial contact force can be adjusted by adjusting the length of the spring portion, allowing e.g. an easy insertion of the electrical pin.

The support blade includes an engaging portion being configured to engage with the corresponding contact blade. The corresponding contact blade may include a corresponding engaging portion being adjacent to the contact portion and a support spring portion. The support spring portion is arranged between the engaging portion and the terminal body.

The support blade may always engage with the corresponding contact blade. The support blade may engage with the corresponding contact blade when an electrical pin is inserted. Thus, the insertion of the electrical pin can be performed with low insertion forces at the beginning of the insertion. An increasing required insertion force that has to be applied when the support blade engages with the corresponding contact blade, i.e. when the contact force increases, can be observed, and may be used as an indicator indicating correct mating of the terminal with the electrical pin.

Further, providing an engaging portion that engages with a corresponding contact blade allows to apply the increased contact force onto the contact blade at a specific area on the contact blade. This area lies within the corresponding engaging portion of the contact blade. To apply the increased contact force directly on the pin, it is advantageous if the corresponding engaging portion of the contact blade is in close proximity to the contact portion and opposite to the contact portion.

The support spring portion is designed to apply a required contact force on the contact blade. Thereby, the support spring portion may be strain optimized. Further, the support spring portion may be provided with beadings, apertures, and the like, to increase the stiffness of the spring portion. Thus, the applied contact force is not dependent on the material thickness of the support spring portion, but on the geometrical shape of the support spring portion.

The geometrical shape of the support blade may be designed to provide a contact force of 1 N to 5 N. These contact forces allow an easy and smooth insertion of a male electrical pin into the electrical terminal, and a secure electrical connection between the terminal and the pin. The higher the contact force, the higher is the allowable vibration or shock level, the electrical terminal can withstand, without unintentionally opening the contact between the electrical terminal and the inserted pin.

The terminal body may have a width of 1.0 to 1.8 mm and a height of 1.6 to 2.3 mm. These dimensions allow to provide very small electrical connectors having high contact forces.

The terminal may be formed from a metal sheet having a thickness of 0.15 to 0.2 mm. These thin metal sheets allow to provide terminals having the dimensions defined above. Still further, these metal sheet thicknesses have shown to be advantageous for the provision of support blades as described before. Further, thinner sheet thicknesses lead to reduced manufacturing and material costs.

The terminal may be integrally formed as one part. An integrally formed terminal, significantly reduces manufacturing costs, since the terminal can be stamped from a single metal sheet and bent subsequently to the desired shape. Thus, no expensive manufacturing steps, such as assembling multiple parts, are necessary.

The terminal body may include a body contact portion that is configured to contact an electrical pin with a contact face when the terminal is mated with the electrical pin and wherein the first sheet plane and/or the contact portion of the contact blade is/are substantially parallel to the contact face and remains substantially parallel to the contact face when the terminal is mated with the electrical pin.

The body contact portion can be an area on an inner wall of the terminal body and may be a protrusion formed in an inner wall of the terminal body. Thus, a defined contact face is formed to contact the pin when the terminal is mated with the pin. A first sheet plane and/or a contact portion of the contact blade that is parallel to the contact face and remains substantially parallel to the contact face when the terminal is mated with the electrical pin, leads to constant contact conditions during the mating. Particularly, since the contact blade does not twist upon mating, a large contact area can be provided. Thus, a secure electrical contact between the electrical pin and the terminal can be achieved.

The contact blade may be configured to that it does not protrude out of the terminal body. The support blade may be configured to that it does not protrude out of the terminal body. Since the support blade and the contact blade may be centered in the terminal, and can be provided with small dimensions, they can be completely provided within the terminal body. Thus, they do not have to protrude out of the terminal body. Therefore, they are protected from being damaged e.g. during the insertion of the terminal into a connector housing. Further, none-protruding contact and/or connector blades are not prone to being unintentionally lifted, so that the electrical contact between the electrical pin and the contact blade is not unintentionally opened.

The terminal body may have a longitudinal mating direction along which the contact blade and the support blade extend. The support blade includes an engaging portion. The engaging portion is configured to transversely engage the corresponding contact blade in a middle portion of the corresponding contact blade. In other words, the engaging portion is contacting or engaging the corresponding contact blade in a middle of the corresponding contact blade seen in a cross sectional plane, i.e. a plane transverse with respect to the longitudinal mating direction. Described another way, the engaging portion extends in line with, and at least partially contacts, a longitudinal center line of the corresponding contact blade. This has as advantage that it allows a reduction of torsional deformation as the engaging portion may now exert a force on the longitudinal center line of the contact blade.

The objective is further solved by an electrical connector assembly including a connector housing and at least one electrical terminal as described above. To assemble the electrical connector assembly, the connector housing receives at least one electrical terminal. Thus, with providing very small electrical terminals, small electrical connectors can be provided.

The objective is further solved by a method to manufacture an electrical terminal as described above. The method includes the steps of cutting a preform from a metal sheet. The preform includes a preform of at least one contact blade, a preform of at least one support blade and a preform of a terminal body. The preforms may be integrally formed and a step of bending the preforms to achieve an electrical terminal. At least one contact blade is formed having a first sheet plane. The contact blade is configured to contact an electrical pin with a contact force when the terminal is mated with an electrical pin; and at least one support blade is formed having a second sheet plane. The support plane engages with a corresponding contact blade to increase the contact force, and wherein the first and second sheet planes are oriented substantially perpendicularly to each other. The method to manufacture allows to provide the inventive electrical terminals having the above-described advantages, with reduced manufacturing costs.

The cutting may be performed with a stamping tool. Stamping is known in the art as being a very cost efficient method to manufacture metal sheet parts. Thus, the manufacturing costs can be reduced.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1A:
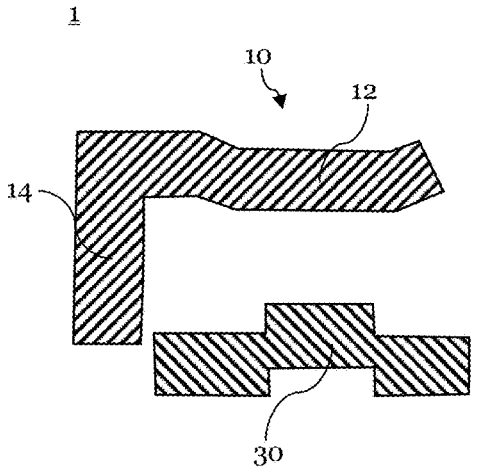
Fig. 1A (Prior Art)
FIG. 1A is a schematic cut view of an electrical terminal according to the prior art.
Figure 1B:
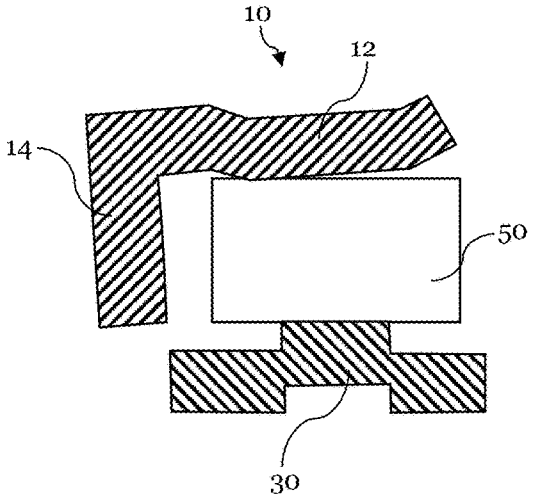
Fig. 1B (Prior Art)
FIG. 1B is a schematic cut view of an electrical terminal according to the prior art that is mated with an electrical pin.
Figure 2A:
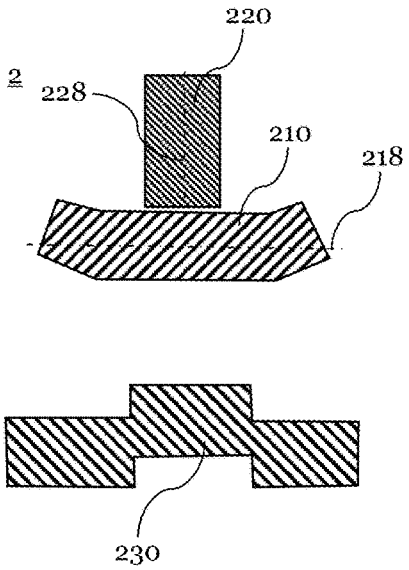
FIG. 2A is a schematic cut view of an electrical terminal according to one embodiment of the invention.
Figure 2B:
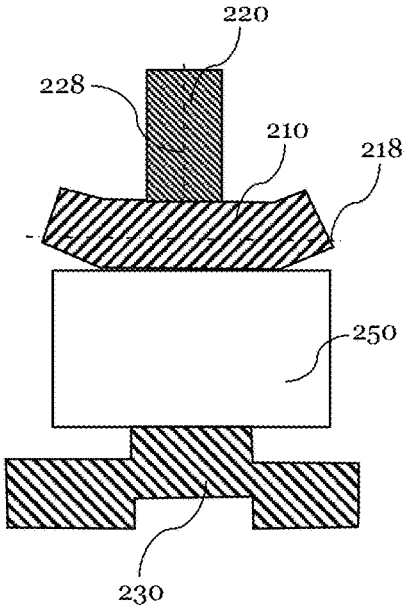
FIG. 2B is a schematic cut view of an electrical terminal that is mated with an electrical pin according to one embodiment of the invention.

FIGS. 2A and 2B show a non-limiting example of an electrical terminal in a schematic cut view of the electrical terminal 2 in which FIG. 2*a* shows the electrical terminal 2 without an inserted electrical pin 250. FIG. 2*b* shows the electrical terminal 2 with an inserted electrical pin 250. The electrical terminal 2 includes a body contact portion 230 for electrically contacting an electrical pin 250 when the electrical pin 250 is mated with the electrical terminal 2. Further, the electrical terminal 2 includes a contact blade 210 and an additional separate support blade 220. The support blade 220 and the contact blade 210 have the same material thickness, since they may be manufactured from the same kind of metal sheet. The contact blade 210 has a first sheet plane 218, and the support blade 220 has a second sheet plane 228. The first and second sheet planes 218, 228 are oriented substantially perpendicularly to each other.

The support blade 220 contacts or engages the contact blade 210 in its middle. An engaging portion of the support blade 220 is adapted to engage the contact blade in the transverse middle of the contact blade. The terminal body contact portion 230 comprises a longitudinal mating direction A along which the contact blade 210 and the support blade 220 extend. The longitudinal mating direction A is perpendicular to the schematic cut view of FIGS. 2A and 2B. The support blade 220 comprises an engaging portion, wherein the engaging portion engages the corresponding contact blade 210 in the transverse middle of the corresponding contact blade 210. In other words, said engaging portion is contacting or engaging the corresponding contact blade 210 in a middle of the corresponding contact blade seen in a cross sectional plane as shown in FIGS. 2A and 2B. This is a plane transverse with respect to the longitudinal mating direction A. Even in other words, the engaging portion extends in line with, and contacts at least partially, a longitudinal center line of the corresponding contact blade 210. This has as advantage that it allows a reduction of torsional deformation, as the engaging portion may now exert a force on the longitudinal center line of the contact blade 210.

Thus, when the electrical pin 250 is inserted into the electrical terminal 2, the contact blade 210 is lifted upwardly without being twisted. It remains parallel to its initial position after lifting. Therefore, a large contact area can be provided between the contact blade 210 and the electrical pin 250. Further, a high contact force can be achieved, since the shape of the additional separate support blade 220 can be designed to provide high contact forces. Thereby, the contact force being applied, is not limited by the material thickness of the support blade 220, but by the geometrical shape.

Figure 3A:
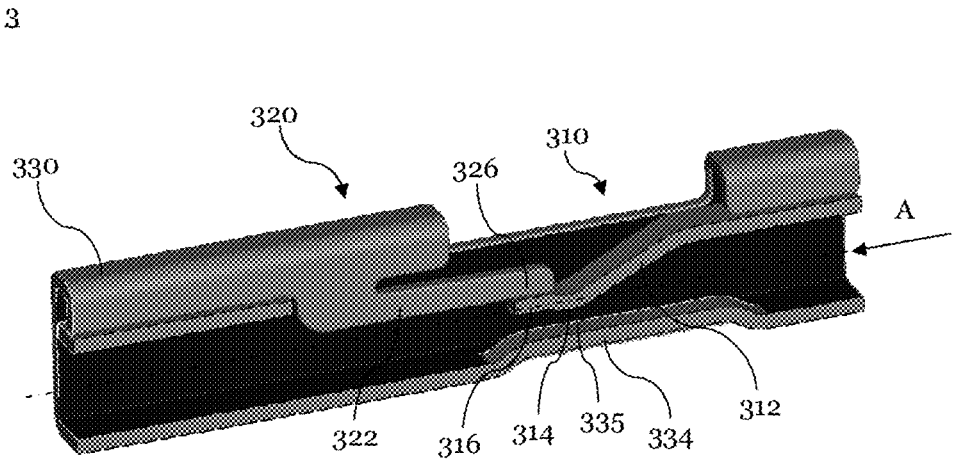
FIG. 3A is a schematic longitudinal cut view of an electrical terminal according to one embodiment of the invention.

FIG. 3A shows an electrical terminal 3 in a longitudinal cut view. Electrical terminal 3 includes a contact blade 310, a separate support blade 320 and a terminal body 330. An electrical pin could be inserted into the electrical terminal 3 along the mating direction A. Thereby, the electrical pin would lift the contact blade 310 while contacting the contact blade 310 electrically. When the contact blade 310 would be lifted, it abuts support blade 320 and engages it, so that an increased contact force would be applied on the electrical pin when the electrical pin would be mated with the electrical terminal 3.

The contact blade 310 includes a spring portion 312 that allows to resiliently bend the contact blade 210. Further, the contact blade 310 includes a contact portion 314 for contacting the electrical pin and a corresponding engaging portion 316 for engaging with the support blade 320. The support blade 320 includes a support spring portion 322 that is designed (i.e. shaped) to apply a desired contact force onto the contact blade 310.

The support blade 320 engages with the contact blade 310 at the engaging portion 326.

Further, the terminal body 330 includes a body contact portion 334 being provided with a contact face 335. The contact portion 314 of the contact blade 310 is substantially parallel to the contact face 335 before, during and after mating the electrical terminal 3 with an electrical pin.

Figure 3B:
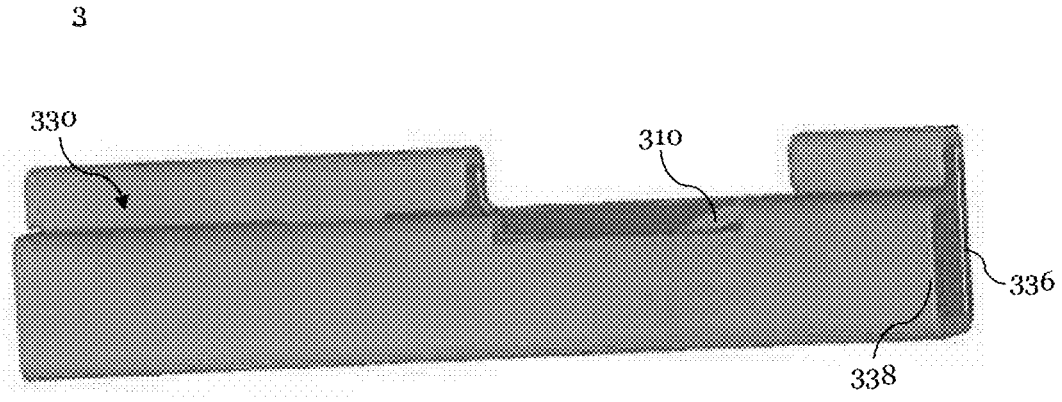
FIG. 3B is a schematic perspective view of an electrical terminal according to one embodiment of the invention.

FIG. 3B is a perspective view of the electrical terminal 3 as shown in FIG. 3A. The terminal includes a terminal body 330, surrounding the contact blade 310 and the separate support blade 320 (not shown). The terminal body 330 has two side walls 336 and 338 and may be integrally formed form one metal sheet.

Figure 4:
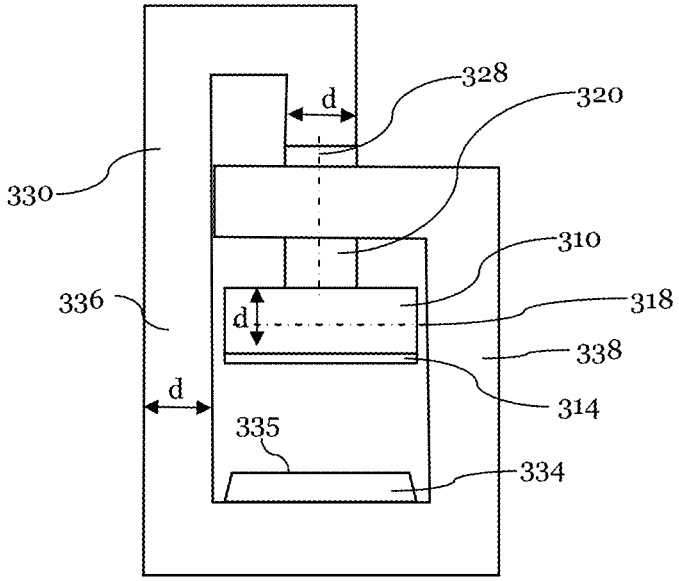
FIG. 4 is a schematic front view of an electrical terminal according to one embodiment of the invention.

FIG. 4 shows a schematic front view of the electrical terminal 3, seen from the front face, opposite to the mating direction A. Electrical terminal 3 is integrally formed from a metal sheet having the sheet thickness d, e.g. the sheet thickness d is 0.15 mm. The metal sheet is cut to form a preform of the terminal, which preform is bend to build the terminal body 330, having two side walls 336 and 338. Further, a body contact portion 334 is provided within the terminal body 330, having a contact face 335 for contacting an electrical pin.

Further, a contact blade 310 having a first sheet plane 318, and a support blade 320 having a second sheet plane 328 are provided. The first and second sheet planes 318, 328 are oriented perpendicularly to each other. Further, the contact blade 310 is centered between the first and second side walls 336, 338. The support blade 320 is arranged symmetrically to the contact blade 310. To avoid a twisting of the contact blade, the contact blade 310 is provided with a contact portion 314 that is oriented parallel to the contact face 335.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

LIST OF REFERENCE NUMBERS

1, 2, 3 electrical terminal
10 contact blade
12 contact portion
14 spring portion
30 contact portion
50 electrical pin
210 contact blade
220 support blade
230 body contact portion
218, 318 first sheet planes
228, 328 second sheet planes
250 electrical pin
310 contact blade
312 spring portion
314 contact portion
316 corresponding engaging portion
318 first sheet plane
320 support blade
322 support spring portion
326 engaging portion
328 second sheet plane
330 terminal body
334 body contact portion
335 contact face
336, 338 side walls
d sheet thickness
A mating direction

We claim:

1. An electrical terminal for a female connector, said electrical terminal comprising:

a terminal body having two opposed side walls;

a contact blade attached to the terminal body configured to contact an electrical pin with a contact force when the electrical terminal is mated with the electrical pin; and a support blade attached to the terminal body separately from the contact blade, wherein the support blade engages the contact blade to increase the contact force on the electrical pin, wherein the contact blade is centered between the two side walls, wherein a width of the support blade between the two opposed side walls is less than a width of the contact blade between the two opposed side walls, wherein the terminal body defines a longitudinal mating direction along which the contact blade and the support blade extend, and wherein the support blade comprises an engaging portion configured to engage the corresponding contact blade transversely in a middle of the corresponding contact blade.

2. The electrical terminal in accordance with claim 1, wherein the support blade and the contact blade are arranged symmetrically between the two opposed side walls.

3. The electrical terminal in accordance with claim 1, wherein the contact blade comprises a contact portion and a spring portion, wherein the contact portion is configured to contact the electrical pin when the electrical terminal is mated with the electrical pin, and wherein the spring portion is arranged between the contact portion and the terminal body.

4. The electrical terminal in accordance with claim 3, wherein the support blade comprises an engaging portion configured to engage the contact blade, wherein the contact blade comprises a corresponding engaging portion, adjacent to the contact portion and a support spring portion, and wherein the support spring portion is arranged between the engaging portion and the terminal body.

5. The electrical terminal in accordance with claim 1, wherein a geometrical shape of the support blade is designed to provide the contact force of at least 1 N.

6. The electrical terminal in accordance with claim 1, wherein the electrical terminal is formed from a metal sheet having a thickness of at most 0.2 mm.

7. The electrical terminal in accordance with claim 1, wherein the electrical terminal is integrally formed as one part.

8. The electrical terminal in accordance with claim 1, wherein the terminal body has a width of at most 1.8 mm and a height of at most 2.3 mm.

9. The electrical terminal in accordance with claim 1, wherein the contact blade comprises a contact portion configured to contact the electrical pin when the electrical terminal is mated with the electrical pin and a spring portion and wherein the spring portion is arranged between the contact portion and the terminal body, wherein the terminal body comprises a body contact portion being configured to contact the electrical pin with a contact face when the electrical terminal is mated with the electrical pin and wherein the contact portion of the contact blade is substantially parallel to the contact face and remains substantially parallel to the contact face when the electrical terminal is mated with the electrical pin.

10. The electrical terminal in accordance with claim 1, wherein the terminal body defines a longitudinal mating direction, wherein the contact blade extends from the terminal body along the mating direction, and wherein the support blade extends from the terminal body along a direction opposite to the mating direction.

11. The electrical terminal in accordance with claim 1, wherein the contact blade does not protrude beyond the terminal body and wherein the support blade does not protrude beyond the terminal body.

12. An electrical terminal for a female connector, said electrical terminal comprising:

a terminal body having two opposed side walls;

a contact blade attached to the terminal body configured to contact an electrical pin with a contact force when the electrical terminal is mated with the electrical pin; and a support blade attached to the terminal body separately from the contact blade, wherein the support blade engages the contact blade to increase the contact force on the electrical pin, wherein a width of the support blade between the two opposed side walls is less than a width of the contact blade between the two opposed side walls.

13. The electrical terminal in accordance with claim 12, wherein the support blade and the contact blade are arranged symmetrically between the two opposed side walls.

14. The electrical terminal in accordance with claim 12, wherein the contact blade comprises a contact portion configured to contact the electrical pin when the electrical terminal is mated with the electrical pin and a spring portion and wherein the spring portion is arranged between the contact portion and the terminal body.

15. The electrical terminal in accordance with claim 14, wherein the support blade comprises an engaging portion configured to engage the contact blade, wherein the contact blade comprises a corresponding engaging portion adjacent to the contact portion and a support spring portion, and wherein the support spring portion is arranged between the engaging portion and the terminal body.

16. The electrical terminal in accordance with claim 12, wherein the support blade is centered between the two side walls.

17. The electrical terminal in accordance with claim 12, wherein the contact blade comprises a contact portion configured to contact the electrical pin when the electrical terminal is mated with the electrical pin and a spring portion and wherein the spring portion is arranged between the contact portion and the terminal body, wherein the terminal body comprises a body contact portion being configured to contact the electrical pin with a contact face when the electrical terminal is mated with the electrical pin and wherein the contact portion of the contact blade is substantially parallel to the contact face and remains substantially parallel to the contact face when the electrical terminal is mated with the electrical pin.

18. The electrical terminal in accordance with claim 12, wherein the terminal body defines a longitudinal mating direction, wherein the contact blade extends from the terminal body along the mating direction, and wherein the support blade extends from the terminal body along a direction opposite to the mating direction.

19. The electrical terminal in accordance with claim 12, wherein the contact blade does not protrude beyond the terminal body and wherein the support blade does not protrude beyond the terminal body.

* * * * *